US010166437B2

(12) United States Patent
Brown et al.

(10) Patent No.: US 10,166,437 B2
(45) Date of Patent: Jan. 1, 2019

(54) BIOMETRIC MONITORING SYSTEM

(71) Applicant: International Business Machines Corporation, Armonk, NY (US)

(72) Inventors: Dean T. Brown, San Francisco, CA (US); Hernan A. Cunico, Holly Springs, NC (US); Martin G. Keen, Cary, NC (US); David W. Messina, Malden on Hudson, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/413,972

(22) Filed: Jan. 24, 2017

(65) Prior Publication Data

US 2018/0207479 A1 Jul. 26, 2018

(51) Int. Cl.
*A63B 24/00* (2006.01)
*G08B 21/18* (2006.01)

(52) U.S. Cl.
CPC ..... *A63B 24/0062* (2013.01); *G08B 21/182* (2013.01); *A63B 2230/06* (2013.01); *A63B 2230/30* (2013.01); *A63B 2230/50* (2013.01)

(58) Field of Classification Search
CPC ..... H03K 17/94
See application file for complete search history.

(56) References Cited

U.S. PATENT DOCUMENTS 7,028,018 B2 4/2006 Kocher
2004/0133080 A1 7/2004 Mazar et al.
2005/0039014 A1 2/2005 Sajkowsky
2008/0131851 A1 6/2008 Kanevsky et al.
2011/0276689 A1 11/2011 Rosen
2012/0137637 A1 6/2012 Gillis
2014/0249853 A1* 9/2014 Proud ..... G06Q 50/24 705/3
2014/0372329 A1 12/2014 Menon et al.
2015/0207915 A1 7/2015 Roberts et al.
2015/0245095 A1 8/2015 Gonzalez
2016/0004224 A1* 1/2016 Pi ..... G04G 21/025 368/10
2016/0037482 A1 2/2016 Higgins et al.
2016/0058367 A1* 3/2016 Raghuram ..... A61B 5/486 600/479
2016/0189051 A1 6/2016 Mahmood
(Continued)

FOREIGN PATENT DOCUMENTS

CN 104239393 A 12/2014
WO 2011094854 A1 8/2011

OTHER PUBLICATIONS

Office Action, dated Jan. 24, 2018, regarding U.S. Appl. No. 15/837,323, 25 pages.
(Continued)

*Primary Examiner* — Amine Benlagsir
(74) *Attorney, Agent, or Firm* — Yee & Associates, P.C.; Daniel Simek

(57) ABSTRACT

Biometric information is monitored for a user. Current activity is identified for the user. The biometric information for the user from an activity tracking device for the user is monitored while a current activity occurs. An alert is generated when the biometric information is out of a desired range for the current activity.

10 Claims, 5 Drawing Sheets

(56) References Cited

U.S. PATENT DOCUMENTS

2016/0235374 A1* 8/2016 Miller ..... A61B 5/7275

OTHER PUBLICATIONS

Final Office Action, dated May 31, 2018, regarding U.S. Appl. No. 15/837,323, 10 pages.
Notice of Allowance, dated Aug. 29, 2018, regarding U.S. Appl. No. 15/837,323, 11 pages.
List of IBM Patents and Applications Treated as Related, 2 pages.

* cited by examiner

BIOMETRIC MONITORING SYSTEM

BACKGROUND

1. Field

The disclosure relates generally to an improved biometric monitoring system, and more specifically, to a method and apparatus for generating alerts in response to biometric information generated during a current activity of a user

2. Description of the Related Art

Biometric information is information that is related to physical human characteristics. For example, biometric information, such as facial characteristics, hand geometry, retina, iris, fingerprints, vein patterns, voice, or other types of biometric information may be used for various purposes. As another example, biometric information may be used to control access to buildings, computers, and other locations or devices. As another example, biometric information such as heat beat rate, respiration rate, or temperature may be used to monitor the health of a patient in a hospital. Biometric information, such as blood pressure pulse, respiration rate, skin conductivity, iris changes, and voice, are used in polygraph systems to detect deception in answers to questions.

SUMMARY

An embodiment of the present disclosure provides an activity monitoring system. The activity monitoring system comprises a computer system. An activity monitor in the computer system identifies the current activity for the user. The activity monitoring system monitors biometric information for the user while the activity occurs. The activity monitoring system generates an alert when the biometric information is out of a desired range for the current activity.

Another embodiment of the present disclosure provides a computer program product for monitoring activity information for a user. The computer program product comprises a computer-readable storage medium, a first program code, a second program code and a third program code. The first program code is stored on the computer-readable storage medium and identifies the current activity for the user. The second program code is stored on the computer-readable storage medium and monitors the biometric information for the user from an activity tracking device for the user while the current activity occurs. The third program code is stored on the computer-readable storage medium and generates an alert when the biometric information is out of a desired range for the current activity.

DETAILED DESCRIPTION

Figure 1:
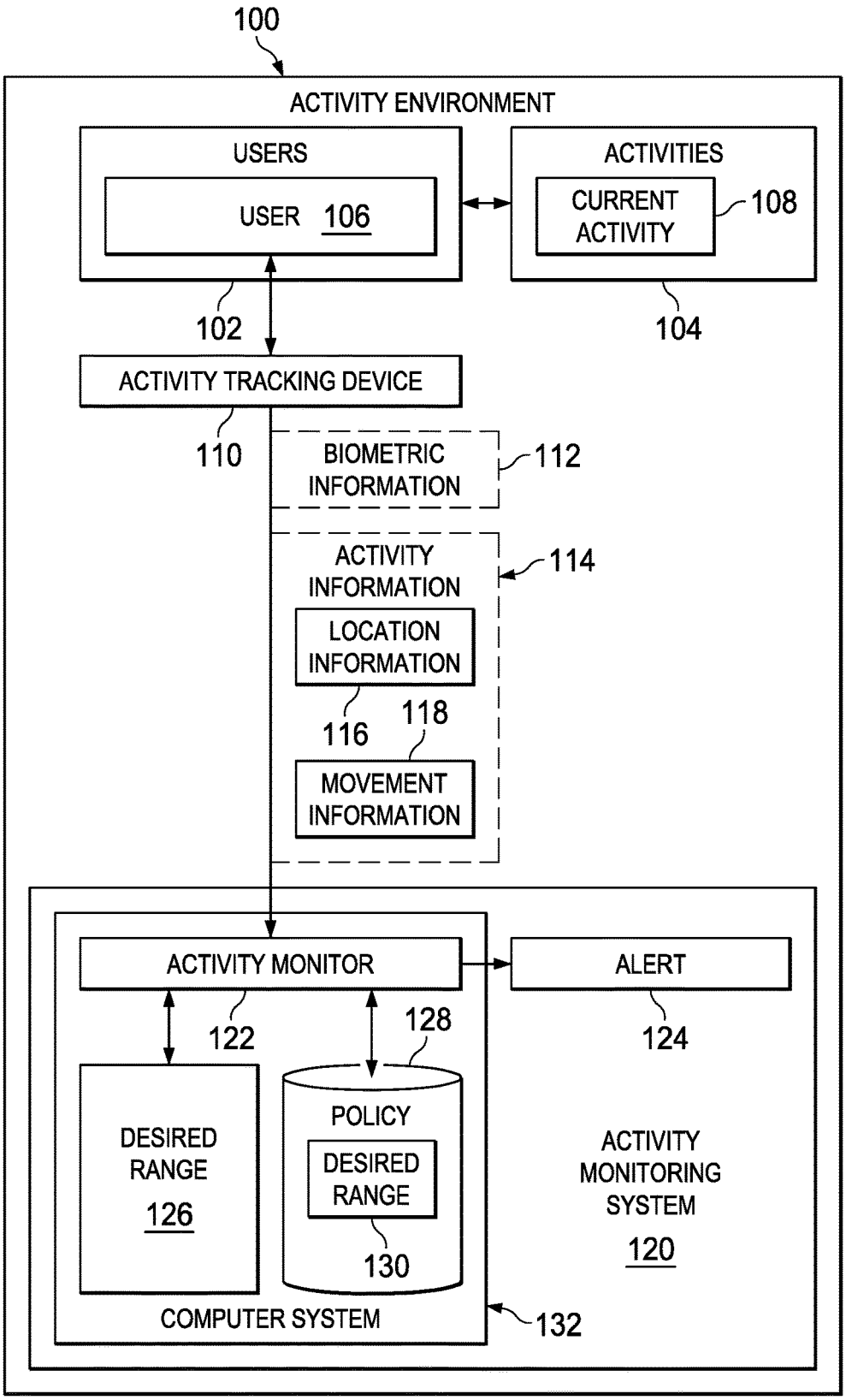
FIG. 1 is an illustration of an activity environment in accordance with an illustrative embodiment.

The present invention may be a system, a method, and/or a computer program product. The computer program product may include a computer-readable storage medium (or media) having computer-readable program instructions thereon for causing a processor to carry out aspects of the present invention.

The computer-readable storage medium can be a tangible device that can retain and store instructions for use by an instruction processing device. The computer-readable storage medium may be, for example, but not limited to, an electronic storage device, a magnetic storage device, an optical storage device, an electromagnetic storage device, a semiconductor storage device, or any other suitable combination of computer-readable storage medium. A non-exhaustive list of more specific examples of computer-readable storage medium include the following: a portable computer diskette, a hard disk, a random access memory (RAM), a read-only memory (ROM), an erasable programmable read-only memory (EPROM or Flash memory drive), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, or any suitable combination of the foregoing. A computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer-readable program instructions described herein can be downloaded to respective computing/processing devices from a computer-readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer-readable program instructions from the network and forwards the computer-readable program instructions for storage to a computer-readable storage medium within the respective computing/processing device.

Computer-readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, or the like, and conventional procedural programming languages, such as the "C" programming language, or similar programming languages. The computer-readable program instructions may be run entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a wide area network (WAN), or the connection may be made to an external computer (for example, through the Internet, using an Internet Service Provider). In some embodiments, electronic circuitry including, for example, programmable logic circuitry, field-programmable gate arrays (FPGA), or programmable logic arrays (PLA) may run the computer-readable program instructions by utilizing state information of the computer-readable program instructions to personalize the electronic circuitry, in order to perform aspects of the present invention.

Aspects of the present invention are described below with reference to flowchart illustrations and/or block diagrams of methods, apparatus (systems) and computer program products according to the embodiments of the invention. It will be understood that each block of the flowchart illustrations and/or block diagrams, and combinations of blocks in the flowchart illustrations and/or block diagrams, can be implemented by computer-readable program instructions.

These computer program instructions may be provided to a processor of a general purpose computer, special purpose computer, or other programmable data processing apparatus to produce a machine, such that the instructions, which are run via the processor of the computer or other programmable data processing apparatus, create means for implementing the functions or acts specified in the flowchart and/or block diagram block or blocks. These computer program instructions may also be stored in a computer-readable medium that can direct a computer, other programmable data processing apparatus, or other devices to function in a particular manner, such that the instructions stored in the computer-readable medium produce an article of manufacture, including instructions which implement the function or act specified in the flowchart and/or block diagram block or blocks.

The computer-readable program instructions may also be loaded onto a computer, other programmable data processing apparatus, or other devices to cause a series of operational steps to be performed on the computer, other programmable apparatus or other devices to produce a computer implemented process, such that the instructions which run on the computer, other programmable apparatus, or other device implement the functions or acts specified in the flowchart and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more instructions for implementing the specified logical function or functions. In some alternative implementations, the functions noted in the blocks may occur out of the order noted in the figures. For example, two blocks shown in succession may, in fact, be run substantially concurrently, or the blocks may sometimes be run in the reverse order, depending upon the functionality involved. It will also be noted that each block of the block diagrams and/or flowchart illustrations, or combinations of blocks in the block diagrams and/or flowchart illustrations, can be implemented by special purpose hardware-based systems that perform the specified functions or acts, or carry out combinations of special purpose hardware and computer instructions.

With reference now to the figures, and in particular with reference to FIG. 1, an illustration of an activity environment is depicted in accordance with an illustrative embodiment. As depicted, activity environment 100 includes users 102 that perform activities 104. User 106 in users 102 performs current activity 108. Current activity 108 is an activity that user 106 is currently engaging in and is selected from a group of activities 104 comprising walking, a sports activity, sitting, sleeping, running, riding a bicycle, or some other suitable type of activity In this illustrative example, user 106 has activity tracking device 110. User 106 may wear, carry, or otherwise keep activity tracking device 110 close enough to generate biometric information 112. As depicted, biometric information 112 is selected from at least one of a heart rate, a blood pressure, a temperature, or other suitable type of information.

Additionally, activity tracking device 110 also may generate activity information 114. As depicted, activity information 114 comprises at least one of location information 116 or movement information 118. As used herein, the phrase "at least one of", when used with a list of items, means different combinations of one or more of the listed items may be used and only one of each item in the list may be needed. In other words, "at least one of" means any combination of items or number of items may be used from the list, but not all of the items in the list are required. The item may be a particular object, a thing, or a category.

For example, without limitation, "at least one of item A, item B, or item C" may include item A, item A and item B, or item B. This example also may include item A, item B, and item C, or item B and item C. Of course, any combination of these items may be present. In some illustrative examples, "at least one of" may be, for example, without limitation, two of item A; one of item B and ten of item C; four of item B and seven of item C; or other suitable combinations.

As depicted, activity monitoring system 120 may be used to identify current activity 108 for user 106. In the illustrative example, activity monitor 122 in activity monitoring system 120 identifies current activity 108 for user 106. Additionally, activity monitor 122 monitors biometric information 112 for user 106 from activity tracking device 110 for user 106 while current activity 108 occurs. Activity monitor 122 generates alert 124 when biometric information 112 is out of desired range 126 for current activity 108.

In this illustrative example, activity monitor 122 may determine whether biometric information 112 is within a desired range 126 using policy 128. For example, activity monitor 122 applies policy 128 to biometric information 112 and current activity 108 for user 106.

Policy 128 identifies a group of desired ranges 130 for a group of activities 104. As used herein, "a group of" when used with reference to an item means one or more items. For example, a group of desired ranges 130 is one or more of desired ranges 130.

In this illustrative example, a group of desired ranges 130 for the group of activities 104 is customized for user 106. Further, policy 128 may include at least one of historical biometric information for the user, a historical anomaly for the user, or other suitable information. Also, activity information 114 may be used with biometric information 112 to determine whether to generate alert 124 and comprises at least one of location information, movement information, or other suitable information.

As depicted, activity monitor 122 may be implemented in software, hardware, firmware or a combination thereof. When software is used, the operations performed by activity monitor 122 may be implemented in program code configured to run on hardware, such as a processor unit. When firmware is used, the operations performed by activity monitor 122 may be implemented in program code and data, and stored in persistent memory to run on a processor unit. When hardware is employed, the hardware may include circuits that operate to perform the operations in activity monitor 122.

In the illustrative examples, hardware may take a form selected from at least one of a circuit system, an integrated circuit, an application specific integrated circuit (ASIC), a programmable logic device, or some other suitable type of hardware configured to perform a number of operations. With a programmable logic device, the device may be configured to perform a number of operations. The device may be reconfigured at a later time or may be permanently configured to perform the number of operations. Programmable logic devices include, for example, a programmable logic array, a programmable array logic, a field programmable logic array, a field programmable gate array, or other suitable types of hardware devices. Additionally, the processes may be implemented in organic components integrated with inorganic components and may be comprised entirely of organic components, excluding a human being. For example, the processes may be implemented as circuits in organic semiconductors.

In this illustrative example, activity monitor 122 may be implemented within computer system 132 located in activity monitoring system 120. Computer system 132 is a physical hardware system and includes one or more data processing systems. When more than one data processing system is present, those data processing systems are in communication with each other using a communications medium. The communications medium may be a network. The data processing systems may be selected from at least one of a computer, a server computer, a tablet, or some other suitable type of data processing system.

Figure 2:
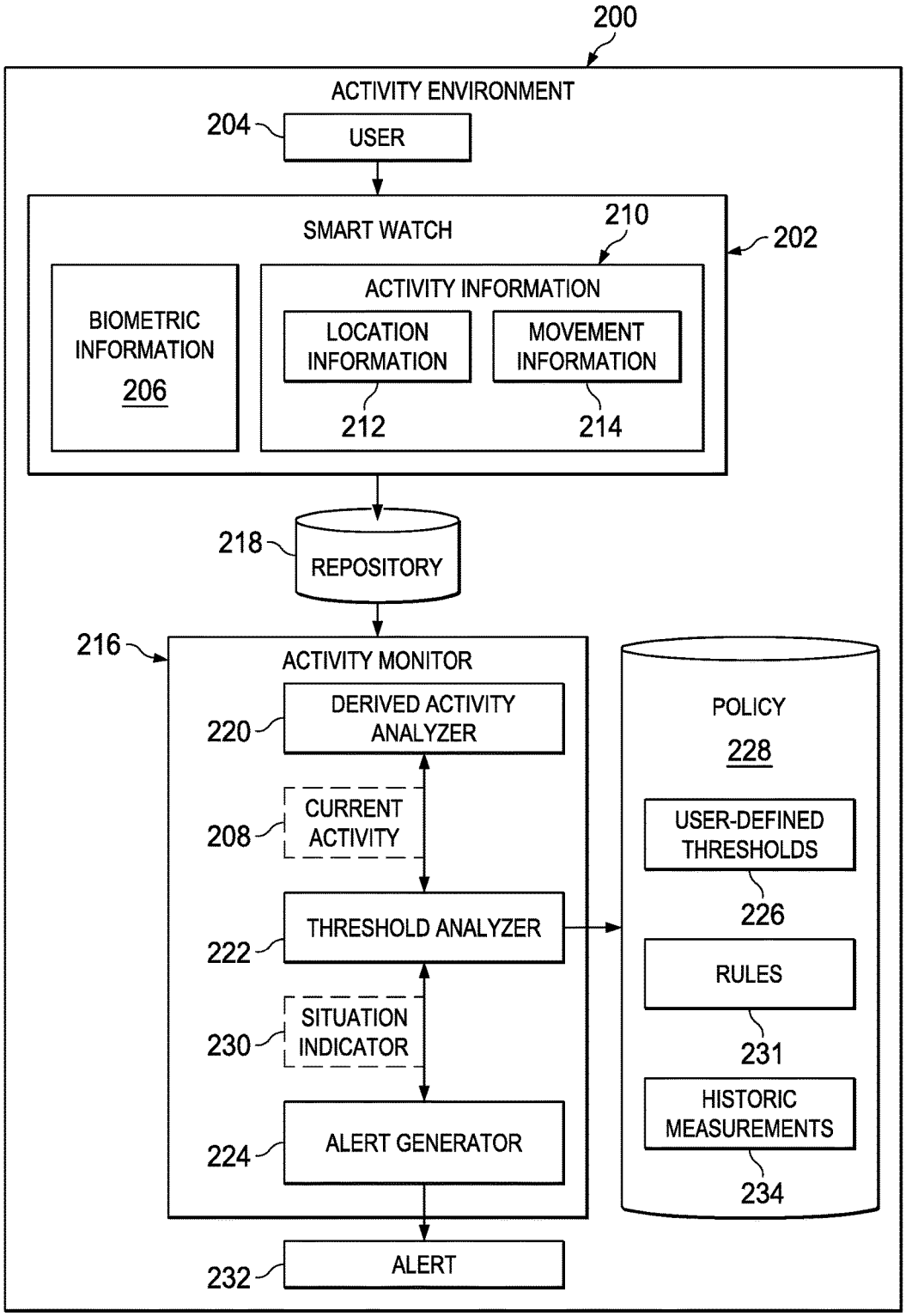
FIG. 2 is an illustration of an activity environment that monitors biometric information from a smart watch in accordance with an illustrative embodiment.

With reference next to FIG. 2, an illustration of an activity environment that monitors biometric information from a smart watch is depicted in accordance with an illustrative embodiment. In this illustrative example, activity environment 200 is an example of one implementation of activity environment 100, as shown in FIG. 1.

In this illustrative example, activity environment 200 includes smart watch 202. Smart watch 202 is an example of an implementation for activity tracking device 110 in FIG. 1.

As depicted, smart watch 202 is worn by user 204, with user 204 being an example of a user in users 102 in FIG. 1. Smart watch 202 generates biometric information 206 for user 204 when user 204 is engaged in current activity 208. In this illustrative example, biometric information 206 includes a number of different types of information for user 204. For example, biometric information 206 may include at least one of a heart rate, a blood pressure, a skin temperature, or other suitable type of biometric information. The heart rate may be derived from a pulse or directly depending on the type of sensors used. Skin temperature may be used as a stress indicator.

Further, smart watch 202 also may generate activity information 210. As depicted, activity information 210 is at least one of location information 212 or movement information 214. In the illustrative example, location information 212 may be derived in a number different ways. For example, a global positioning system (GPS) receiver in smart watch 202 may generate location information 212. Alternatively, another mobile device having global positioning system (GPS) capabilities that is paired with smart watch 202 may generate location information 212. The other mobile devices may be, for example, a mobile phone, a tablet computer, or some other suitable type of mobile device.

As depicted, movement information 214 may include different types of information about the movement of user 204. For example, movement information 214 may include steps taken, stairs climbed, time standing, time inactive, rate of movement during sleep, change in speed of movement, or other types of information.

Smart watch 202 sends this information is sent to activity monitor 216. In particular, the information is stored in repository 218. Repository 218 is a storage system for biometric information 206, location information 212, and movement information 214 that may be accessed for use by activity monitor 216.

In this illustrative example, activity monitor 216 is an example of an implementation for activity monitor 122 in FIG. 1. Activity monitor 216 includes derived activity analyzer 220, threshold analyzer 222, and alert generator 224. These components in activity monitor 216 may be implemented in at least one of hardware or software.

As depicted, derived activity analyzer 220 uses at least one of location information 212 or movement information 214 in activity information 210 to identify current activity 208 for user 204. Activity analyzer 220 also may derive current activity 208 by analyzing activity information 210. A number of different techniques may be used to perform this analysis. For example, neural language processing, visual recognition, or other suitable techniques may be used. Further, these techniques may use other information in addition to the information located in repository 218.

In the illustrative example, derived activity analyzer 220 may use the location of user 204 as an indicator of the current activity. For example, if user 204 is located in a location of an office, it is likely that user 204 is working for current activity 208.

In another example, calendar entries for user 204 also may reveal current activity 208 for user 204. As depicted, derived activity analyzer 220 analyzes appointments in calendar entries to identify the current activity. For example, a calendar entry may show a schedule with a tennis league game. With this information, derived activity analyzer 220 may identify playing tennis as current activity 208 for user 204 at the time of the calendar entry.

In another illustrative example, derived activity analyzer 220 can use social network postings to identify current activity 208 for user 204. For example, a social check-in at a restaurant may indicate that current activity 208 for user 204 is eating food. As another example, instant messages also may be used to indicate current activity 208 for user 204.

In addition, derived activity analyzer 220 can also use email messages. For example, the content of an email message may contain an invoice for a concert. As a result, current activity 208 for user 204 may be attending the concert when the time of the concert occurs.

Derived activity analyzer 220 generates identification of multiple current activities with the confidence level, along with an indication of the most likely activity that is current activity 208. As depicted, the confidence level is directly related to the strength of the information used to derive the confidence level. For example, if a calendar entry states the user is currently engaged in a certain activity ("play tennis with Bill") and a social network check-in correlates with this activity (checked in at "Cary Tennis Park"), then a higher confidence level is assigned than if only one piece of information was available (for example, just the calendar entry).

In this illustrative example, derived activity analyzer 220 sends current activity 208 to threshold analyzer 222. As depicted, threshold analyzer 222 utilizes user-defined thresholds 226 in policy 228 to determine whether an undesired situation is present. The particular threshold or thresholds in user-defined thresholds 226 may be selected based on rules 231 in policy 228 that defines which ones of user-defined thresholds 226 should be used for a particular activity. Threshold analyzer 222 then determines whether biometric information 206 is outside of the threshold in user-defined thresholds 226.

In these illustrative examples, user-defined thresholds 226 may take various forms. For example, user-defined thresholds 226 may include general thresholds that may be applicable in any situation. A general threshold may include one or more metrics. For example, a general threshold may include, for example, beats per minute (BPM), location, time inactive, or a combination.

Beats per minute is a threshold in which the heart rate that the user should not exceed is a selected level, such as 170 beats per minute, regardless of current activity 208. Location is a threshold in which user 204 should not be at a particular location. Time inactive is a threshold of how much time passes before the threshold is exceeded. For example, the threshold may be exceeded if user 204 has not been active in the past three hours. A combination is a combination of thresholds. For example, a combination is a combination of location and time inactive. With this example, user 204 should not be at a specific location after 10:00 PM.

Further, user-defined thresholds 226 may include thresholds derived from activities. For example, biometric information 206 may be used to identify thresholds from rules in policy 228 based on activities engaged in by user 204. An example of a derived activity threshold is when the derived activity identified as current activity 208 is playing tennis, the heart rate should not be greater than 110 beats per minute. When current activity 208 is a work meeting, the heart rate should not exceed 90 beats per minute.

Further, policy 228 may include historical measurements 234 from biometric information 206. Historical measurements 234 may be used to identify additional thresholds in user-defined thresholds 226. Historical measurements 234 may include biometric information 206 that defines a normal or usual range for biometric information 206 for a particular activity. For example, when current activity 208 is watching a sporting event, historical measurements 234 for biometric information 206 may include average heart rates from about 65 beats per minutes to 90 beats per minutes. A heart rate of 120 beats per minutes would be considered out of the normal range identified in historical measurements 234.

In another example, when current activity 208 is attending a work meeting, biometric information 206 and historical measurements 234 may include a range of skin temperatures that indicates stress level from about one to four for this activity. A stress level of eight would be considered outside of this range derived from biometric information 206 and historical measurements 234.

When biometric information 206 is outside of one or more of user-defined thresholds 226, an abnormal condition may be present in which user 204 is in need of assistance. In another example, biometric information 206 for a particular activity may be inconsistent with current activity 208. This inconsistency may not require assistance but may still cause an alert to be generated for user 204.

In this illustrative example, threshold analyzer 222 generates situation indicator 230 when biometric information 206 is outside of user-defined thresholds 226. Situation indicator 230 is sent to alert generator 224 for processing.

As depicted, alert generator 224 identifies a recipient for alert 232 as well as a type of alert to generate. The recipient of alert 232 may be selected from user 204, a care giver, a medical professional, a doctor, a nurse, or some other suitable recipient. The recipient may be a predefined recipient that is specified by user 204. In another example, the recipient may be one based on whether an abnormal condition or inconsistent activity data are present.

In this illustrative example, alert 232 may include a number of types of information. For example, alert 232 may include at least of current activity 208, a confidence level of current activity 208, or an identification of user-defined thresholds 226 that have been exceeded.

Figure 3:
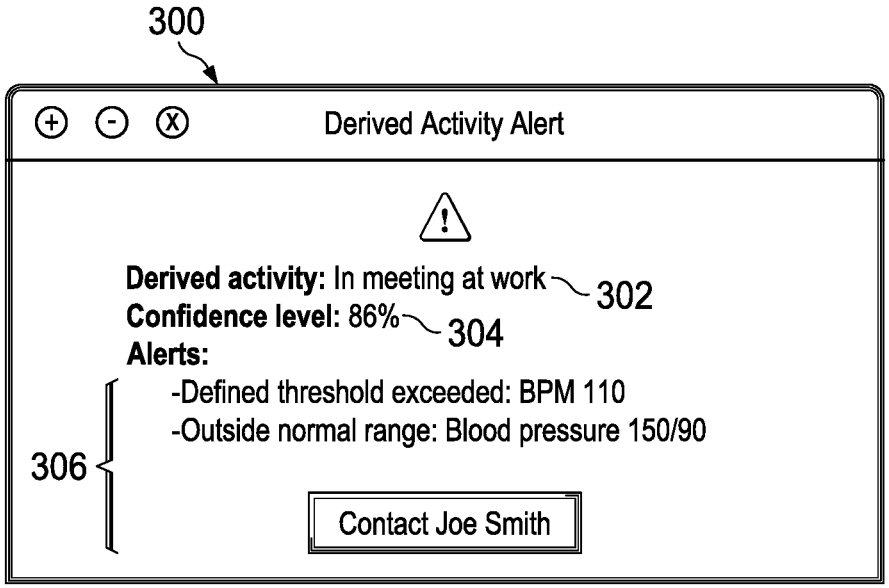
FIG. 3 is an illustration of an alert in accordance with an illustrative embodiment.
Figure 4:
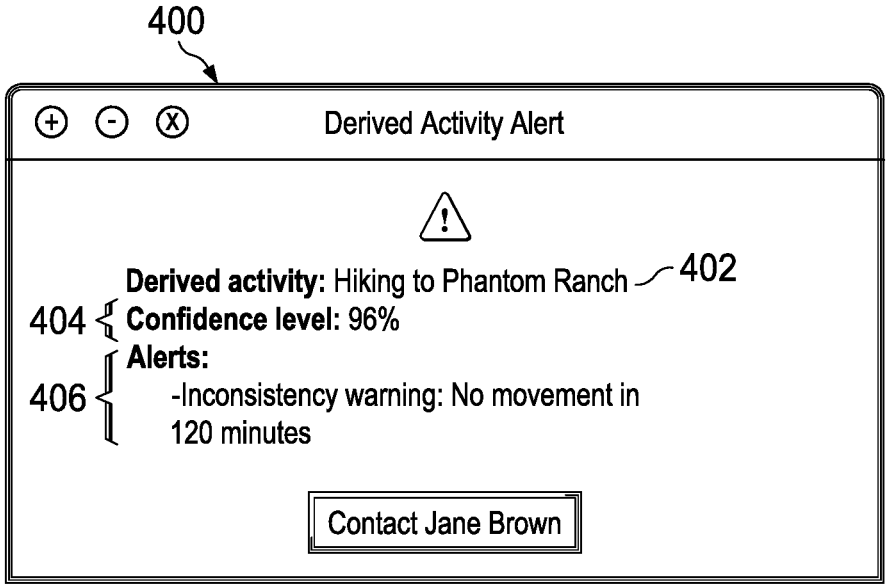
FIG. 4 is another illustration of an alert in accordance with an illustrative embodiment.

Turning now to FIGS. 3 and 4, illustrations of alerts that may be displayed in a computer system are depicted in accordance with an illustrative embodiment. With reference first to FIG. 3, an illustration of an alert is depicted in accordance with an illustrative embodiment. As depicted, alert 300 is an example of an implementation for alert 124 in FIG. 1 and alert 232 in FIG. 2. A computer system displays alert 300 and the computer system may be selected from one of an activity tracking device, a laptop computer, or some other suitable type of data processing system.

Alert 300 is for a current activity that is identified for a user. As depicted, alert generator 224 in FIG. 2 generates alert 300. In this illustrative example, alert 300 includes current activity 302, Confidence level 304, and alert message 306.

With reference next to FIG. 4, another illustration of an alert is depicted in accordance with an illustrative embodiment. In this depicted example, alert 400 is another example of an implementation for alert 124 in FIG. 1 and alert 232 in FIG. 2. A computer system displays alert 400 and the computer system may be, for example, an activity tracking device, a laptop computer, or some other suitable type of data processing system.

Alert generator 224 in FIG. 2 generates alert 400 is for a current activity that is identified for a user. In this illustrative example, alert 400 include current activity 402, confidence level 404, and alert message 406.

The illustration of alert 300 in FIG. 3 and alert 400 in FIG. 4 are presented only for purposes of illustrating some implementations for alert 124 in FIG. 1 and alert 232 in FIG. 2. In other illustrative examples, the alert may take the form of an audio or verbal alert in addition to or in place of the alerts displayed in FIG. 3 and FIG. 4.

The illustration of activity environments and different components in the activity environments in FIGS. 1-4 are not meant to imply physical or architectural limitations to the manner in which an illustrative embodiment may be implemented. Other components, in addition to or in place of the ones illustrated, may be used. Some components may be unnecessary. Also, the blocks in the block diagrams are presented to illustrate some functional components. One or more of these blocks may be combined, divided, or combined and divided into different blocks when implemented in an illustrative embodiment.

For example, one or more activity tracking devices are present in addition to activity tracking device 110 in FIG. 1. Further, users 102 also may carry other mobile devices that may be linked to or paired to their activity tracking devices. In another illustrative example, other types of wearable technology devices may be used to implement activity tracking device 110 in place of smart watch 202, as shown in FIG. 1 and FIG. 2, respectively. For example, fitness trackers may be used.

Figure 5:
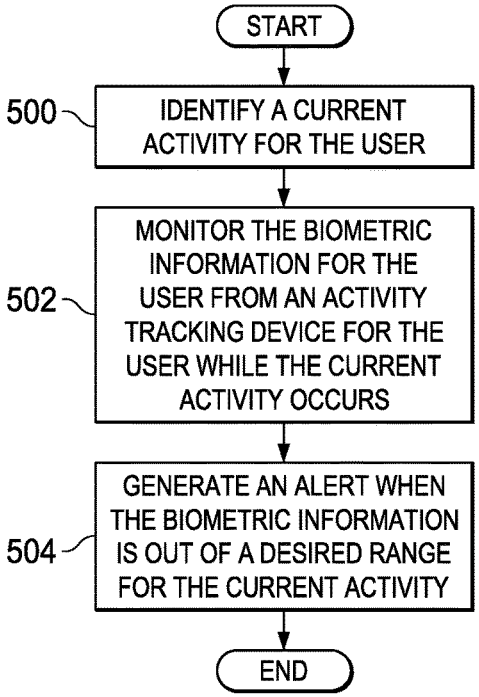
FIG. 5 is a high-level flowchart of a process for monitoring biometric information for a user in accordance with an illustrative embodiment.

Turning next to FIG. 5, a high-level flowchart of a process for monitoring biometric information for a user is depicted in accordance with an illustrative embodiment. The process illustrated in FIG. 5 may be implemented in an activity monitor such as activity monitor 122 in FIG. 1 or activity monitor 216 in FIG. 2. The different steps illustrated may be embodied as program code or in hardware, depending on the particular implementation.

The process begins by identifying a current activity for the user (step 500). In step 500, the current activity is identified using at least one of movement information generated by the activity tracking device, heart beat information, user input identifying the current activity, a schedule for the user, a location of the user, or other suitable types of information.

The process monitors the biometric information for the user from an activity tracking device for the user while the current activity occurs (step 502). The process generates an alert when the biometric information is out of a desired range for the current activity (step 504). The process terminates thereafter.

In step 504, the process may display the alert on the activity tracking device. In another example, the process may send the alert to an assistance provider selected from a group comprising: a care giver, a medical professional, a doctor, a nurse, or some other suitable entity.

Figure 6:
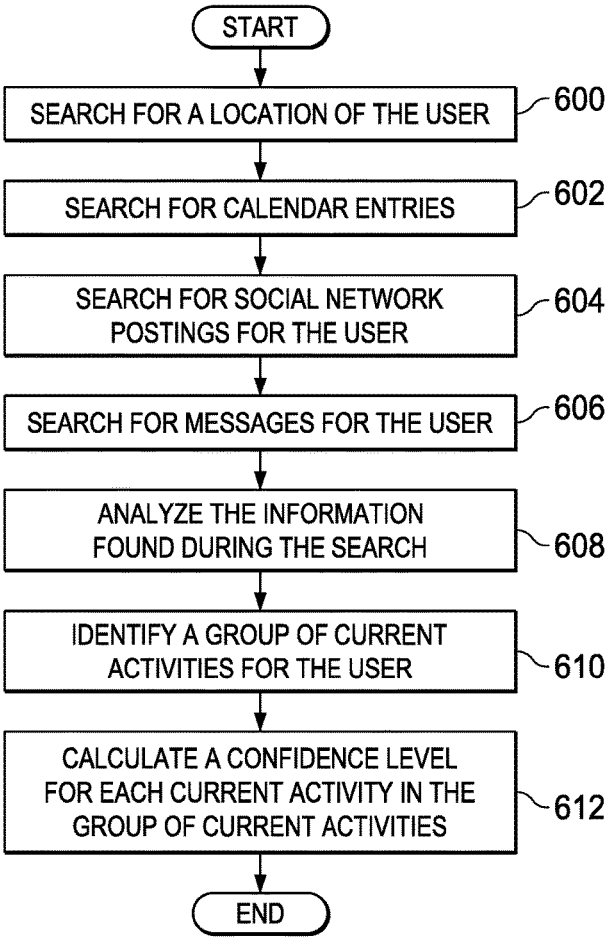
FIG. 6 is a flowchart of a process for identifying a current activity in accordance with an illustrative embodiment.

In FIG. 6, a flowchart of a process for identifying a current activity is depicted in accordance with an illustrative embodiment. The process illustrated in FIG. 6 is an example of one implementation for step 500 in FIG. 5. The different steps illustrated may be embodied as program code or in hardware, depending on the particular implementation.

The process begins by searching for a location of the user (step 600). The process searches for calendar entries (step 602). The process then searches for social network postings for the user (step 604). The process searches for messages for the user (step 606).

The process analyzes the information found during the search (step 608). The process identifies a group of current activities for the user (step 610). The process calculates a confidence level for each current activity in the group of current activities (step 612). The process terminates thereafter.

Figure 7:
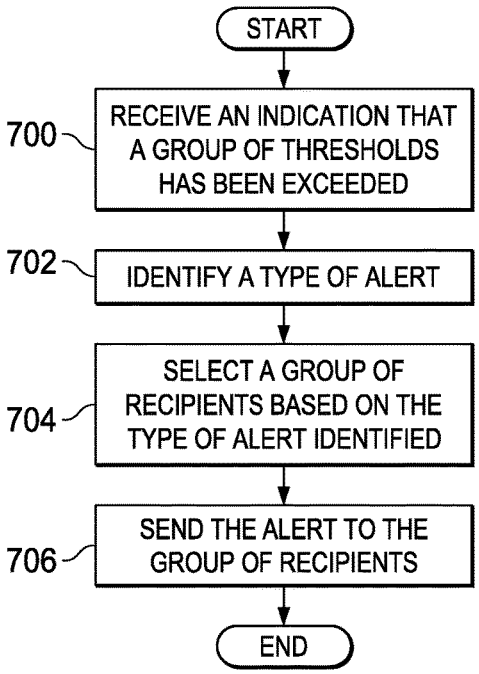
FIG. 7 is a flowchart of a process for generating an alert in accordance with an illustrative embodiment.

With reference to FIG. 7, a flowchart of a process for generating an alert is depicted in accordance with an illustrative embodiment. The process illustrated in FIG. 7 is an example of one implementation for step 504 in FIG. 5. The different steps illustrated may be embodied as program code or in hardware, depending on the particular implementation.

The process begins by receiving an indication that a group of thresholds has been exceeded (step 700). The process identifies a type of alert (step 702). In step 702, the alert may be one in which the biometric information is outside of a normal range or one in which the biometric information indicates that an abnormal condition is present. The process selects a group of recipients based on the type of alert identified (step 704). The process sends the alert to the group of recipients (step 706), with the process terminating thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step. For example, one or more of the blocks may be implemented as program code, hardware, or a combination of the program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware. Each block in the flowcharts or the block diagrams may be implemented using special purpose hardware systems that perform the different operations or combinations of special purpose hardware and program code run by the special purpose hardware.

For example, some of steps 602 through 608 in FIG. 6 may be omitted. In the illustrative examples, a search may be made for at least one of the pieces of information described in these steps.

In some alternative implementations of an illustrative embodiment, the function or functions noted in the blocks may occur out of the order noted in the figures. For example, in some cases, two blocks shown in succession may be performed substantially concurrently, or the blocks may sometimes be performed in the reverse order, depending upon the functionality involved. Also, other blocks may be added in addition to the illustrated blocks in a flowchart or block diagram.

Figure 8:
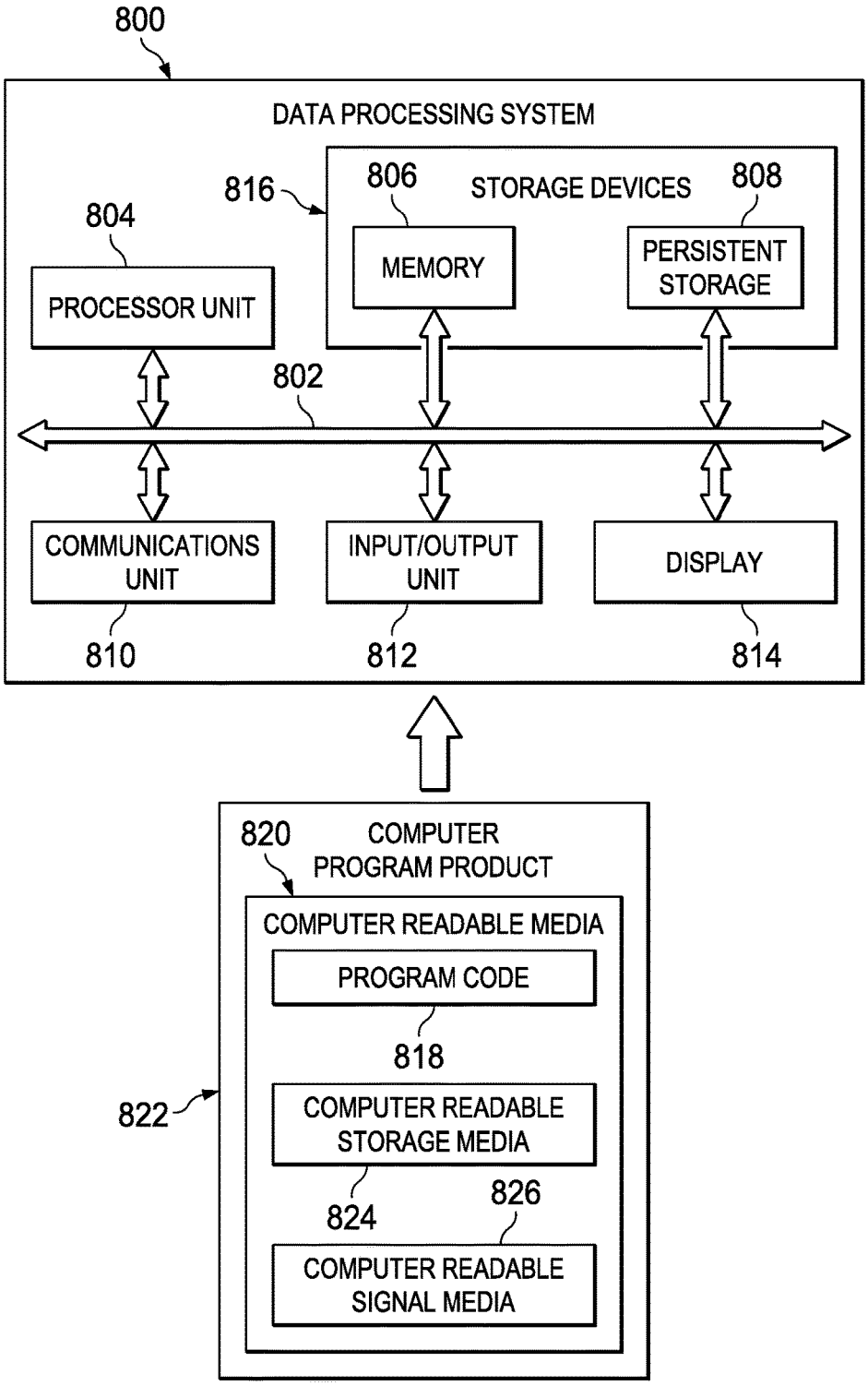
FIG. 8 is an illustration of a block diagram of a data processing system in accordance with an illustrative embodiment.

Turning now to FIG. 8, an illustration of a block diagram of a data processing system is depicted in accordance with an illustrative embodiment. Data processing system 800 may be used to implement computer system 132, activity tracking device 110 as shown in FIG. 1, or smart watch 202 as shown in FIG. 2. In this illustrative example, data processing system 800 includes communications framework 802, which provides communications between processor unit 804, memory 806, persistent storage 808, communications unit 810, input/output unit 812, and display 814. In this example, communication framework may take the form of a bus system.

Processor unit 804 serves to process instructions for software that may be loaded into memory 806. Processor unit 804 may be a number of processors, a multi-processor core, or some other suitable type of processor, depending on the particular implementation.

Memory 806 and persistent storage 808 are examples of storage devices 816. A storage device is any piece of hardware that is capable of storing information, such as, for example, without limitation, at least one of data, program code in functional form, or other suitable types of information either on a temporary basis, a permanent basis, or both on a temporary basis and a permanent basis. Storage devices 816 may also be referred to as computer-readable storage devices in these illustrative examples. Memory 806, in these examples, may be, for example, a random access memory or any other suitable volatile or non-volatile storage device. Persistent storage 808 may take various forms, depending on the particular implementation.

For example, persistent storage 808 may contain one or more components or devices. For example, persistent storage 808 may be a hard drive, a solid state hard drive, a flash memory drive, a rewritable optical disk, a rewritable magnetic tape, or some combination of the above. The media used by persistent storage 808 also may be removable. For example, a removable hard drive may be used for persistent storage 808.

Communications unit 810, in these illustrative examples, provides for communications with other data processing systems or devices. In these illustrative examples, communications unit 810 is a network interface card.

Input/output unit 812 allows for input and output of data with other devices that may be connected to data processing system 800. For example, input/output unit 812 may provide a connection for user input through at least one of a keyboard, a mouse, or some other suitable type of input device. Further, input/output unit 812 may send output to a printer. Display 814 provides a mechanism to display information to a user.

Instructions for at least one of the operating system, applications, or programs may be located in storage devices 816, which are in communication with processor unit 804 through communications framework 802. Processor unit 804 performs processes in the different embodiments using computer-implemented instructions, which may be located in a memory, such as memory 806.

These instructions are referred to as program code, computer usable program code, or computer-readable program code that may be read and run by a processor in processor unit 804. The program code in the different embodiments may be embodied on different physical or computer-readable storage media, such as memory 806 or persistent storage 808.

Program code 818 is located in a functional form on computer-readable media 820 that is selectively removable and processed by processor unit 804 when loaded onto or transferred to data processing system 800. Program code 818 and computer-readable media 820 form computer program product 822 in these illustrative examples. In one example, computer-readable media 820 may be computer-readable storage media 824 or computer-readable signal media 826.

In these illustrative examples, computer-readable storage media 824 is a physical or tangible storage device used to store program code 818 rather than a medium that propagates or transmits program code 818.

Alternatively, program code 818 may be transferred to data processing system 800 using computer-readable signal media 826. Computer-readable signal media 826 may be, for example, a propagated data signal containing program code 818. For example, computer-readable signal media 826 may be at least one of an electromagnetic signal, an optical signal, or any other suitable type of signal. These signals may be transmitted over at least one of communications links, such as wireless communications links, optical fiber cable, coaxial cable, a wire, or any other suitable type of communications link.

The different components illustrated for data processing system 800 are not meant to provide architectural limitations to the manner in which different illustrative embodiments may be implemented. The different illustrative embodiments may be implemented in a data processing system including components, in addition to or in place of those illustrated, for data processing system 800. Other components shown in FIG. 8 can be varied from the illustrative examples shown. The different embodiments may be implemented using any hardware device or system capable of running program code 818.

Thus, illustrative embodiments of the present invention provide a computer implemented method, computer system, and computer program product for monitoring biometric information for user. In one illustrative example, a computer system identifies a current activity for the user. The computer system also monitors the biometric information for the user from an activity tracking device for the user while the current activity occurs. The computer system generates an alert when the biometric information is out of a desired range for the current activity.

In this manner, the illustrative examples allow for generating alerts based on changes in the types of activities for the user. When thresholds for biometric information are of concern, a policy is used to identify when an alert is generated. The policy includes rules and data for selecting thresholds for different types of activities that a user may perform. In this illustrative example, the thresholds are customized for a particular user.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. The terminology used herein was chosen to best explain the principles of the embodiment, the practical application or technical improvement over technologies found in the marketplace, or to enable others of ordinary skill in the art to understand the embodiments disclosed herein.

The flowcharts and block diagrams in the figures illustrate the architecture, functionality, and operation of possible implementations of systems, methods, and computer program products according to various embodiments of the present invention. In this regard, each block in the flowcharts or block diagrams may represent a module, a segment, or a portion of code, which comprises one or more instructions for implementing the specified logical function or functions. It should also be noted that, in some alternative implementations, the functions noted in the block may occur out of the order noted in the figures. For example, two blocks shown in succession may, in fact, be processed substantially concurrently, or the blocks may sometimes be processed in the reverse order, depending upon the functionality involved. It will also be noted that each block of the block diagrams and/or flowchart illustrations, or combinations of blocks in the block diagrams and/or flowchart illustrations, can be implemented by special purpose hardware-based systems that perform the specified functions or acts, or combinations of special purpose hardware and computer instructions.

What is claimed is:

1. A computer system for monitoring activity information for a user, the computer system comprising:

a storage device, wherein the storage device stores program instructions; and a processor coupled to the storage device via a communications framework, wherein the processor executes the program instructions to:

receive biometric information corresponding to the user from an activity tracking device worn by the user that generated the biometric information;

identify a current activity of the user;

monitor the biometric information corresponding to the user being received from the activity tracking device worn by the user while the current activity occurs;

generate an identification of the current activity;

generate a confidence level percentage value corresponding to the identification of the current activity that is directly related to an amount of information utilized to derive the confidence level percentage value identifying the current activity of the user;

generate an alert that includes the identification of the current activity, the confidence level percentage value corresponding to the identification of the current activity, an identification of a desired range for the current activity, and an identification of a user-specified recipient corresponding to the alert when the biometric information is out of the desired range for the current activity; and display the alert that includes the identification of the current activity, the confidence level percentage value corresponding to the identification of the current activity, the identification of the desired range for the current activity, and the identification of the user-specified recipient corresponding to the alert on a display of the activity tracking device worn by the user.

2. The computer system of claim 1, wherein an activity monitor of the computer system applies a policy to the biometric information and the current activity of the user.

3. The computer system of claim 2, wherein the policy identifies a group of desired ranges for a group of activities.

4. The computer system of claim 3, wherein the group of desired ranges for the group of activities are defined by the user.

5. The computer system of claim 3, wherein the policy includes at least one of historical biometric information corresponding to the user and a historical anomaly corresponding to the user.

6. The computer system of claim 2, wherein the activity monitor identifies the current activity using at least one of movement information generated by the activity tracking device, the biometric information generated by the activity tracking device, a user input identifying the current activity, a schedule for the user, and location information for the user.

7. A computer program product for monitoring activity information for a user, the computer program product comprising:

a computer-readable storage medium;

a first program code, stored on the computer-readable storage medium, for receive biometric information corresponding to the user from an activity tracking device worn by the user that generated the biometric information;

a second program code, stored on the computer-readable storage medium, for identifying a current activity of the user;

a third program code, stored on the computer-readable storage medium, for monitoring the biometric information corresponding to the user being received from the activity tracking device worn by the user while the current activity occurs;

a fourth program code, stored on the computer-readable storage medium, for generating an identification of the current activity;

a fifth program code, stored on the computer-readable storage medium, for generating a confidence level percentage value corresponding to the identification of the current activity that is directly related to an amount of information utilized to derive the confidence level percentage value identifying the current activity of the user;

a sixth program code, stored on the computer-readable storage medium, for generating an alert that includes the identification of the current activity, the confidence level percentage value corresponding to the identification of the current activity, an identification of a desired range for the current activity, and an identification of a user-specified recipient corresponding to the alert when the biometric information is out of the desired range for the current activity; and a seventh program code, stored on the computer-readable storage medium, for displaying the alert that includes the identification of the current activity, the confidence level percentage value corresponding to the identification of the current activity, the identification of the desired range for the current activity, and the identification of the user-specified recipient corresponding to the alert on a display of the activity tracking device worn by the user.

8. The computer program product of claim 7 further comprising:

an eighth program code, stored on the computer-readable storage medium, for applying a policy to the biometric information and the current activity of the user and the policy includes at least one of historical biometric information corresponding to the user and a historical anomaly corresponding to the user.

9. The computer program product of claim 7 further comprising:

a ninth program code, stored on the computer-readable storage medium, for identifying the current activity using at least one of movement information generated by the activity tracking device, heart beat information, user input identifying the current activity, a schedule for the user, and a location of the user.

10. The computer program product of claim 7, wherein the biometric information is selected from at least one of a heart beat rate, a blood pressure, and a temperature.

* * * * *